United States Patent [19]

Nasser

[11] Patent Number: 4,757,687

[45] Date of Patent: Jul. 19, 1988

[54] SYSTEM FOR CURRENT GENERATION

[76] Inventor: Gamal E. D. Nasser, Egenhofer Strasse 2, 8039 Puchheim, Fed. Rep. of Germany

[21] Appl. No.: 57,429

[22] Filed: Jun. 2, 1987

[30] Foreign Application Priority Data

Jun. 7, 1986 [DE] Fed. Rep. of Germany ..... 3619269

[51] Int. Cl.[4] ..... F01K 7/00

[52] U.S. Cl. ..... 60/675; 60/641.11; 60/653; 60/676

[58] Field of Search ..... 60/641.1, 641.11, 644.1, 60/648, 653, 655, 675, 676, 693, 698

[56] References Cited

U.S. PATENT DOCUMENTS 4,192,145 3/1980 Tanaka ..... 60/641.1

FOREIGN PATENT DOCUMENTS 2465980 4/1981 France ..... 60/675

*Primary Examiner*—Stephen F. Husar

*Attorney, Agent, or Firm*—Krass & Young

[57] ABSTRACT

An electric power generating system includes a substantially conically tapering tower adapted to provide for the condensation of a vaporized fluid which has risen to the top of the tower. The condensate falls back to ground level, in a stream which actuates an electrical current generating turbine. The system can provide for the vaporization of the fluid to occur as a result of proximal association with a flowing water source, and a subsequent super heating of the vaporized fluid by proximal association with a source of waste heat such as a neighboring power plant.

16 Claims, 5 Drawing Sheets

SYSTEM FOR CURRENT GENERATION

BACKGROUND OF THE INVENTION

The invention relates to a system for generating electric power with the aid of an energy carrier cycle.

In the hitherto known power stations the questions of fuel disposal, security problems, cost-benefit problems and environmental problems have been solved in an unsatisfactory manner. Thermal power stations are operated on the basis of fossil fuels exclusively, such fuels being available in only limited amount and becoming more and more expensive. The burning of fossil fuels causes substantial environmental damages. Solar power stations cannot be operated in northern industrial states, are expensive in construction and cause considerable maintenance costs. Power stations making use of the earth temperature will achieve only a low output, and further there occur unsolved corrosion problems which have neither been solved in the hitherto proposed ocean-temperature-slope power stations.

SUMMARY OF THE INVENTION

It is the object of the invention to provide a system for the generation of electric current, such system being inoffensive to the environment, causing comparatively low costs and being very efficient, the power output being adaptable to the respective current demand both in winter and in summer.

The system according to the invention comprises a very high and substantially conically tapering tower which is located above a ring channel that is supplied with water diverted from a nearby river. The wall of the tower includes a plurality of uptakes which are preferably arranged in a plane containing the central axis of the tower. Further a fall down pipe is arranged inside the tower, said pipe being connected with a fluid turbine. At the upper end portion of the tower there are provided means for condensing a gaseous energy carrier, said means comprising at least one condenser.

In the ring channel there are provided, below the uptakes, first heat exchangers which serve as evaporators, and above said first heat exchangers there are arranged further heaters for the energy carrier.

The system according to the invention includes an energy carrier cycle, in which first a liquid energy carrier is evaporated in the first heat exchangers by the comparatively warm water of the ring channel, whereupon the energy carrier vapor is heated in the succeeding superheaters to a higher temperature preferably by the waste heat of a neighboring second power plant. The energy carrier vapor travels up inside the uptakes to a considerably higher position where, due to the substantially colder ambient temperature, it is condensed in means provided for this purpose. Thereupon the liquid energy carrier falls through the fall down pipe onto a fluid turbine which is connected with the generator of a power plant for current generation. Finally the energy carrier is resupplied to the evaporator.

In this way the system according to the invention uses a combination of a gaseous and a liquid energy carrier in order to obtain first potential energy of the energy carrier after the supply of heat in the evaporator and the succeeding superheater, which potential energy is then converted into kinetic energy. It is of importance that the temperature in the upper portion of the tower is sufficiently lower than the temperature of the water.

The tower, which for statical reasons is upwardly tapered, is perferably made of steel concrete, and the uptakes may be designed in one piece with the wall of the tower. There may be provided ten uptakes, each having a diameter of about twelve meters.

As the tower reaches up to a considerable height and for statical reasons significantly widens downwardly, it will inevitably have a large interior space which may be particularly preferably dimensioned in a manner that the power station required for the current generation may be located inside the tower.

Preferably the tower may cover an already existing nuclear power plant, the waste heat of which is used for superheating the energy carrier vapor. Thus, there is no need for the otherwise required cooling towers of the nuclear power station, and thanks to the shielding wall of the tower the nuclear power plant is provided with considerable safety against effluent radioactive media. To this end, burstproof intermediate ceilings may be built inside the tower in order to further stabilize it.

The energy carrier may suitably be a mixture of energy carriers. This has the advantage that owing to an appropriate selection of the mixture the vaporization point and the condensation point may be adjusted to appropriate values. For instance, the energy carrier may be a mixture of coolants composed of $C_3H_8$ and $NH_3$, whereby during cold seasons the proportion of $NH_3$ and in summer the proportion of $C_3H_8$ may be reduced.

The means for condensing the risen energy carrier vapor are suitably arranged on a platform which is situated on the upper end portion of the tower. When the superheated vapor of the energy carrier reaches said platform, it has already been cooled down by several degrees, but has not yet attained the saturation limit.

Suitably the vapor is first cooled down in a counterflow system up to close to the saturation limit before being condensed in a forced draught air cooler. A pump may then increase the pressure level of the condensate before the latter enters the counterflow system where it is heated while the energy carrier vapor is cooled down. Thereupon the liquid energy carrier may be cooled down step by step in containers provided for this purpose, and the resulting working steam may be used for turbines driving the forced draught fans, a fluid pump and an additional current generator.

The tower according to the invention may have a height of about 3,000 meters and a maximum diameter of about 1,000 meters. Such a height of the tower ensures a sufficient temperature difference between the water temperature and the air temperature in the area of the upper platform, so that the system may be operated both during the cold and the warm season.

In order to lower the costs for the construction of the tower to a significant extent, the height of the tower may be reduced to about 1,000 meters, but in that case for ensuring a sufficient difference in temperature the ring channel is connected with a water basin designed as a solar collector, in which the water is heated prior to being contacted with the heat exchangers. Thanks to such arrangement, by which the water supplied to the first heat exchangers may be heated e.g. by 25 degrees centigrade, a standstill of the plant in summer can reliably be excluded.

The water basin may have a black ground and a transparent upper plastic covering, whereby the basin is designed as a particularly inexpensive solar collector. The dimensions of the basin may be considerably reduced when it is provided with solar cells, same being however associated with considerable costs.

The basin has suitably the form of an elongated rectangle with lateral lengths of e.g. 5,000 meters and 2,000 meters. It may be in communication, via two connection lines, with the water-bearing channel at such places which are situated before and after the ring channel, where there may be provided swingable shutters which lock either the connection lines or the water-bearing channel. When the water-bearing channel is closed while the connection lines are opened, the water in the basin may be led by a pump arrangement in a cycle through the ring channel, so that the water in the basin then is a "substitute river" with increased water temperature. In summer the basin water is in the daytime suitably pumped in a cycle, whereas at night the basin is closed, because owing to the large cooling in the area of the upper end of the tower there is then a sufficient temperature difference. In the cold seasons a sufficient temperature difference is ensured anyway.

When the tower has a height of only about one thousand meters, the energy carrier should be a fluid having a relatively high density. In this way, the mass which lacks as compared with a drop height of three thousand meters can be compensated. Thus, using an energy carrier of higher density may lead to the same output as if a higher tower were used. This is achieved with the so-called freon coolants such as $CF_2Cl_2$, $CHF_2Cl$, $CH_3CF_3Cl$, $C_4F_8$ and $CH_3Cl$ or other appropriate agents.

The system according to the invention has the advantage that no fossil fuels are consumed and that it works most inoffensive to the environment. Owing to the fact that heat is withdrawn from the water diverted from a river to the ring channel, the living conditions in the river water, that is normally affected by considerable waste heat, are improved. The operating costs of the system according to the invention are kept at a minimum, and the output energy may at any time be adapted to the current demand.

For the generation of energy there are used fluid turbines which, as compared with common steam turbines, are considerably cheaper, more compact and practically maintenance-free. Besides that, the fluid turbines have a much higher efficiency.

In respect of the effectivity of the system according to the invention, the air coolers are of particular importance. Particularly suitable are wave surface air coolers such as are described in West German Laying Open Print (DE-OS) No. 3,239,816 published on 12/1/83. With the aid of such wave surface air coolers the condensation of the energy carrier on the platform of the tower may be performed easily and conveniently. In order that the counterflow system and the evaporation apparatuses need not have too large dimensions, it may be expedient to divide the waste heat of the neighboring second power plant, e.g. a nuclear power station, that is also located inside the tower, in a manner that only one third of the waste heat is supplied to the second heat exchangers which superheat the energy carrier vapor, whereas two thirds of the waste heat are used for evaporating the energy carrier.

Further features, advantages and details of the invention will be seen from the following description of some embodiments, by reference to the accompanying drawing.

DETAILED DESCRIPTION OF THE PREFERRED EMBODIMENTS

Figure 1:
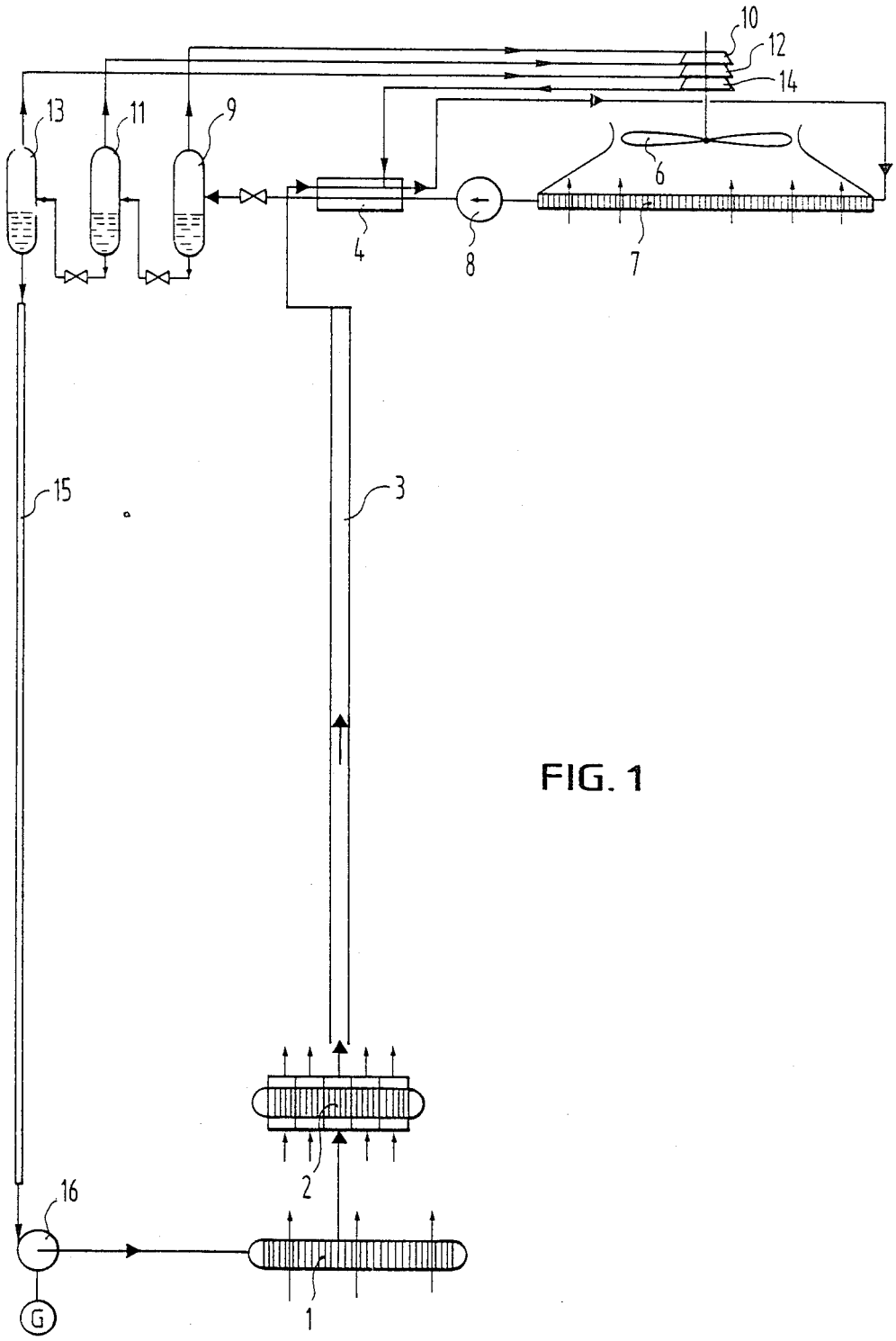
FIG. 1 is a diagram to show the energy carrier cycle.
Figure 5:
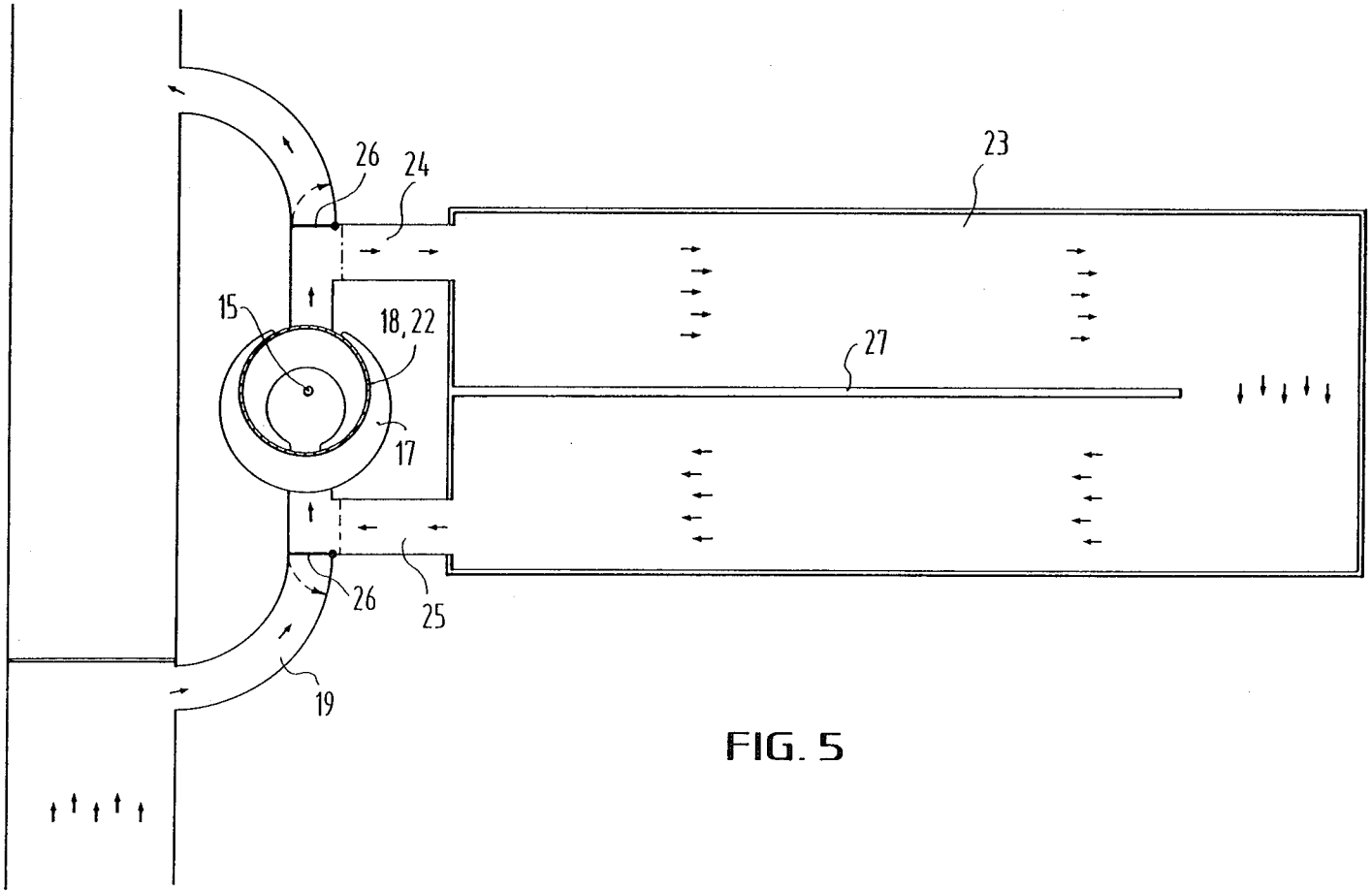
FIG. 5 is a plan view, partially cut, to the embodiment according to FIG. 4.

Reference is had first to FIG. 1. Through a first heat exchanger 1 water is led from a ring channel 17 (FIGS. 3 and 5) towards an energy carrier so that the energy carrier evaporates and the water cools down. In a second heat exchanger 2 arranged thereabove the energy carrier vapor is further heated by several degrees centigrade through condensation of the exhaust steam from the turbine of a neighboring power plant. The superheated energy carrier vapor then rises in an uptake 3 to a considerable height which should range between 1,000 and 3,000 meters. At the end of said uptake pipe the energy carrier vapor has already cooled down by several degrees, but is not yet saturated.

In a counterflow system the vapor is cooled down up to close to the saturation limit. The energy carrier vapor then passes into an air cooler 7 associated with a fan 6, in which air cooler the vapor is liquefied. A pump 8 will then increase the pressure level of the condensate before the latter is led through the counterflow system 4. In the containers 9, 11, 13 the liquid cools further down step by step. Thereby working steam is set free for the turbines 10, 12, 14 which drive the fan 6 and other aggregates.

The liquid then leaves the container 13 in a condition that prevails also in the evaporator 1. In a fall down pipe 15 the liquid energy carrier falls down onto a turbine 16 which is connected to a generator G of a power station. The energy carrier then reaches again its initial state at the heat exchanger 1.

Figure 2:
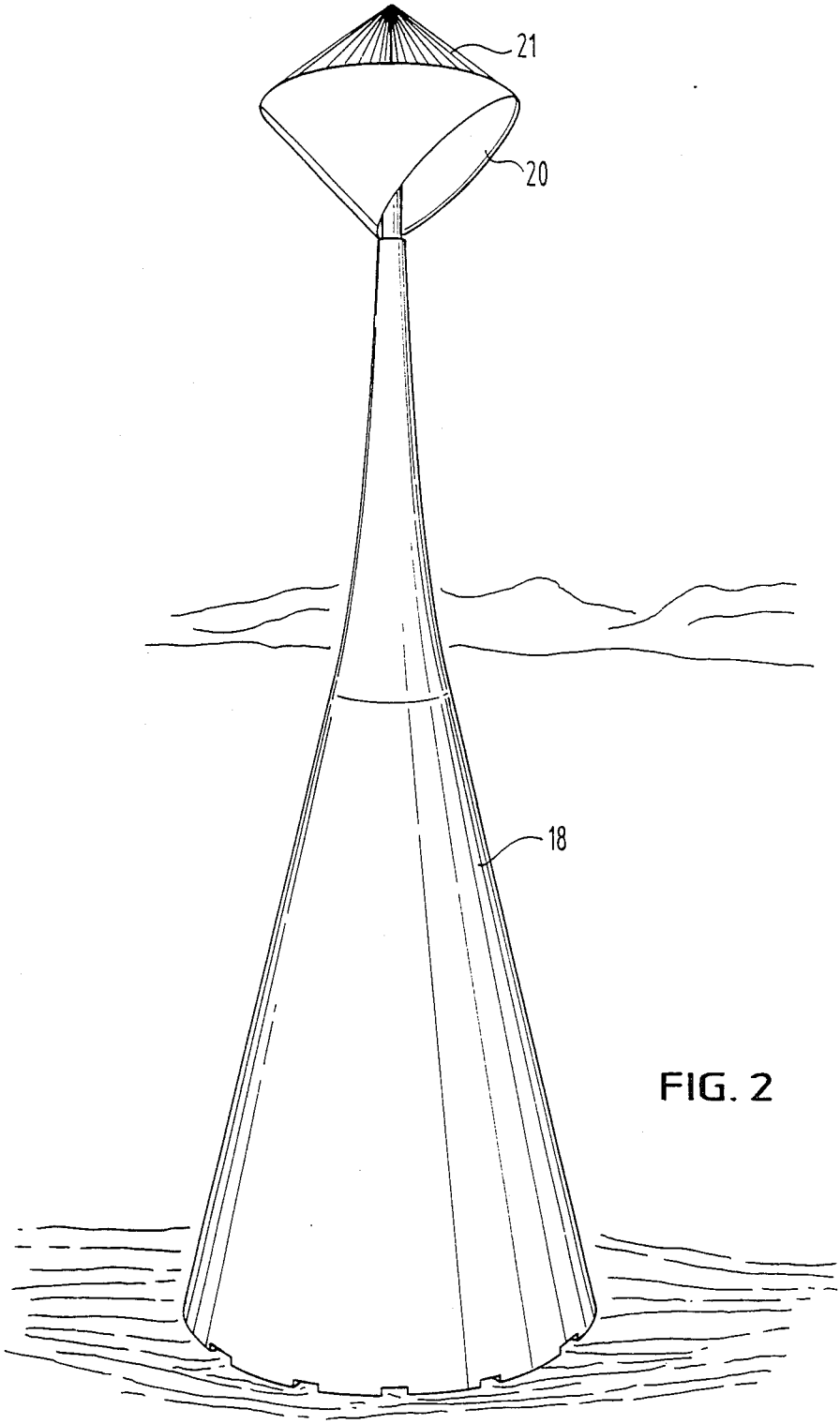
FIG. 2 is a side view of a first embodiment of the system according to the invention.

FIG. 2 shows an embodiment of a tower 18 having a height of about 3,000 meters. The base of the tower 18 has a diameter of about 1,000 meters, said tower being arranged above a ring channel 17 bearing water that is diverted via a channel 19 (FIGS. 3 and 5) from a nearby river.

At the upper end of the tower 18 there is located a platform 20 which is supported by steel cables 21. On this platform there are arranged the means for liquefying the rising energy carrier vapor.

In the embodiment shown in FIG. 2, the large height of the tower ensures at any season a sufficient temperature difference for the energy carrier cycle.

Figure 4:
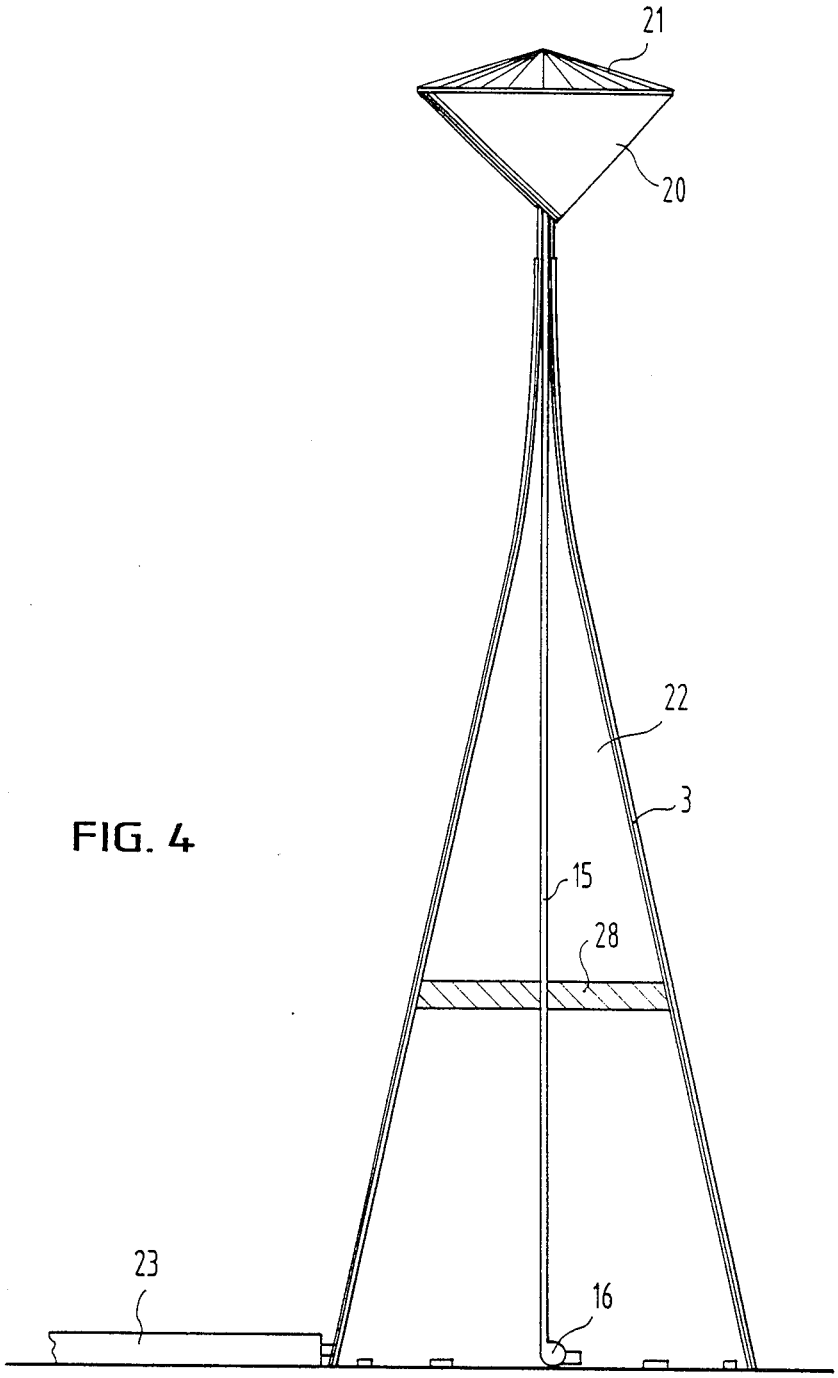
FIG. 4 is a longitudinal cross-section through a second embodiment of the system according to the invention.

The tower 22 shown in FIG. 4 is distinguished from the above described embodiment basically only in that its height is about 1,000 meters. In such case additional measures must be taken to ensure in the energy carrier cycle the temperature difference required for continuous operation. For this purpose the system is provided with a basin 23 designed as a solar collector as described more in detail hereinafter. Additionally, in the area of the upper end portion of the tower 18, 22 there could be, pivotally arranged, a dynamic pressure well, oriented in the wind direction to generate a dynamic pressure to further improve the cooling effect.

As to be seen from FIG. 4, the uptakes 3 run along the wall of the tower, while the fall down pipe 15 is arranged approximately in the tower axis. As schematically indicated in FIG. 4, there may be arranged a generating plant as well as a nuclear power station in the inside space of the tower, where one or more partitions 28 in the tower 22 will provide additional security.

Figure 3:
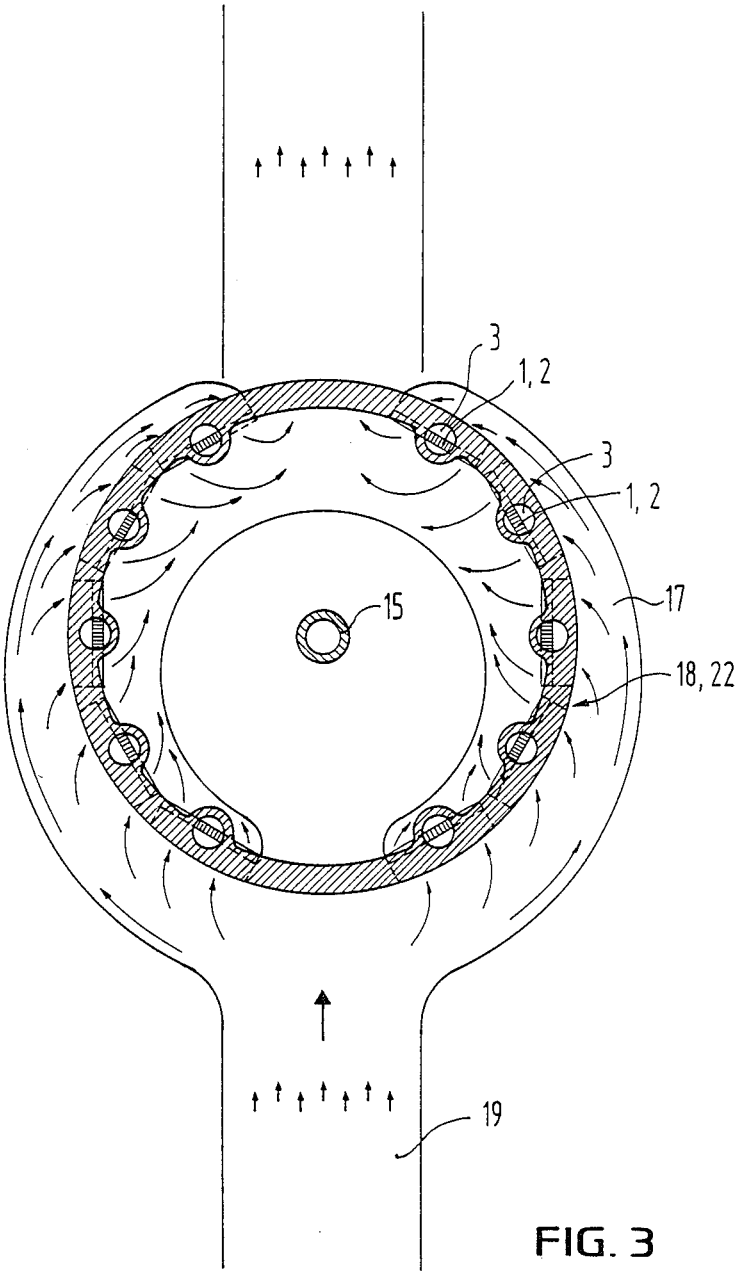
FIG. 3 is horizontal section through the system according to the invention.

FIG. 3 shows that the uptakes 3 are designed in one piece with the concrete wall of the tower 18, 22 and arranged over the first and second heat exchangers 1, 2. The lower heat exchangers 1 are located in the ring channel 17 which is supplied via the channel 19 with relatively warm water from a nearby river, whereby heat is withdrawn from the water at the heat exchangers 1. The defluent water has a temperature that may be decreased by about 5° C.

The uptakes 3 have a diameter of 12 meters, whereas the central fall down pipe has a diameter of 7 meters only.

As the tower has a height of only about 1,000 meters, it is necessary, for achieving a sufficient temperature difference, to provide in the energy carrier cycle a basin 23 which is in communication with the channel 19 via connection channels 24, 25 at places before and after the ring channel 17. By means of shutters 26 either the channel 19 or a connection channel 24, 25 may be released while the respective other channel is closed. Thus, the ring channel 17 may alternatively be supplied with water from the channel 19, i.e. from the nearby river, or from the basin 23, in which a pump arrangement (not shown) may cause the basin water to circulate in a cycle that is indicated by the arrows shown in FIG. 5.

The ground of the basin 23 is colored black, and the top of the flat basin is covered with a transparent plastic covering, whereby a water temperature of about 65° C. may be achieved. The basin has an elongated form with lateral lengths of 5,000 and 2,000 meters respectively. A partition 27 serves to cause the whole basin water to circulate.

During the warm season the water heated in the basin 23 is in the daytime used for evaporating the energy carrier, because due to the relatively high temperatures at the upper end of the tower there is no sufficient temperature difference then. At night the connection channels 24, 25 are closed again as the temperature in the area of the platform of the tower quickly drops to a level where the required temperature difference is given.

I claim:

1. A system for generating electrical power from the evaporation and condensation of an energy carrier, said system including:

a ring channel adapted to retain a volume of water therein;

a volume of energy carrier fluid;

a first heat exchanger in operative communication with the water in the ring channel and the energy carrier fluid, and adapted to transfer heat from the water to the energy carrier so as to provide an energy carrier vapor;

a second heat exchanger in operative communication with a source of waste heat from a neighboring second power plant and with the energy carrier vapor, and adapted to transfer heat from the waste heat source to the vapor so as to superheat that vapor;

a substantially conically tapering tower;

a plurality of uptakes associated with a wall of the tower and adapted to collect said vapor and convey it to the top of the tower;

condenser means disposed atop the tower and adapted to condense the vaporized energy carrier so as to provide a fluid;

a fall down pipe disposed within the tower and having a first end in operative communication with the condenser so as to receive the fluid, said fall down pipe adapted to have the fluid fall to a second end thereof proximate the base of the tower and including a fluid turbine disposed so as to be turned by the falling fluid; and, an electrical generator of a first power plant in operative communication with the turbine.

2. System according to claim 1, characterized in that the tower is made of steel concrete and that the uptakes are designed in one piece with the wall of the tower.

3. System according to claim 1, characterized in that there are provided ten uptakes, each having a diameter of about 12 meters.

4. System according to claim 1, characterized in that the first power plant is located inside the tower.

5. System according to claim 1, characterized in that the energy carrier is a mixture of energy carriers.

6. System according to claim 1, characterized in that the means for condensing the risen energy carrier vapor are arranged on a platform which is located on the upper end portion of the tower.

7. System according to claim 6, characterized in that on the platform there is arranged a counterflow system which, in the flow direction of the energy carrier vapor, is arranged upstream of the condenser.

8. System according to claim 7, characterized in that the condenser is a forced draught air cooler provided with a fan driven by turbines.

9. System according to claim 7, characterized in that a pump is inserted between the condenser and the counterflow system.

10. System according to claim 6, characterized in that on the platform there are further arranged containers in which the liquid energy carrier is cooled down step by step.

11. System according to claim 6, characterized in that in the area of the upper end portion of the tower there is pivotally arranged a dynamic pressure wall oriented in the wind direction to generate a dynamic pressure for improving the cooling effect.

12. System according to claim 1, characterized in that the tower is about three thousand meters high and has a maximum diameter of about one thousand meters.

13. System according to claim 1, characterized in that the tower is about one thousand meters high and that the ring channel is in communication with a water basin designed as a solar collector, in which the water is heated prior to being contacted with the first heat exchanger.

14. System according to claim 13, characterized in that the basin is in communication with a water-bearing channel via two connection channels at places before and after the ring channel, which water-bearing channel may be closed by locks when the connection channels are opened, and the water in the basin, by means of a pump arrangement, forms a cycle including the ring channel.

15. System according to claim 14, characterized in that in summer the basin water is in the daytime pumped in a cycle and that the basin is closed at other times.

16. System according to claim 1, characterized in that the energy carrier is a high density fluid.

* * * * *